US005236109A

United States Patent [19]

Zuckerman

[11] Patent Number: 5,236,109

[45] Date of Patent: Aug. 17, 1993

[54] MULTIGARMENT HANGER WITH PLURAL CLIPS

[75] Inventor: Andrew M. Zuckerman, Forest Hills, N.Y.

[73] Assignee: Different Dimensions Inc., Rego Park, N.Y.

[21] Appl. No.: 912,946

[22] Filed: Jul. 13, 1992

[51] Int. Cl.[5] ..... A47G 25/48; A47G 25/14

[52] U.S. Cl. ..... 223/96; 223/95; 223/85; 24/567

[58] Field of Search ..... 223/96, 95, 93, 91, 223/90, 85; 211/113; D6/315, 326; 24/485, 567, 564

[56] References Cited

U.S. PATENT DOCUMENTS

| | | | |
|---|---|---|---|
| 2,129,455 | 9/1938 | Wisehart et al. | 223/96 X |
| 3,738,549 | 6/1973 | Driscoll . | |
| 4,623,079 | 11/1986 | Tendrup et al. . | |
| 4,629,102 | 12/1986 | Tendrup et al. . | |
| 4,828,155 | 5/1989 | Louw | 223/93 X |
| 4,871,097 | 10/1989 | Blanchard et al. . | |
| 5,040,686 | 8/1991 | Morrow . | |
| 5,062,556 | 11/1991 | Willpütz | 223/96 |
| 5,065,916 | 11/1991 | Fildan | 223/96 X |
| 5,069,373 | 12/1991 | Kolton et al. . | |
| 5,074,447 | 12/1991 | Kolton et al. . | |
| 5,092,502 | 3/1992 | Kolton et al. . | |

FOREIGN PATENT DOCUMENTS

| | | | |
|---|---|---|---|
| 2120542 | 12/1983 | United Kingdom | 223/96 |

*Primary Examiner*—Clifford D. Crowder
*Assistant Examiner*—Bibhu Mohanty
*Attorney, Agent, or Firm*—Amster, Rothstein & Ebenstein

[57] ABSTRACT

A multigarment hanger of plastic construction, such as a bra-and-panty hanger, includes a centrally located suspending member for being suspended from a support, a body connected to the base of the suspending member and oriented horizontally when used, and, at each of the opposite ends of the body, plural garment-engaging grips molded integrally therewith. One of the grips is defined by a vertically oriented wall surface of the hanger and a first resilient finger to define a first clearance space therebetween defining a first garment-receiving slot, and at least another of the grips is defined by a horizontally oriented wall surface and a second resilient finger to define a second clearance space therebetween defining a second garment-receiving slot. At least a portion of the vertically oriented wall surface of the one grip is horizontally displaceable without affecting the second clearance space of any other grip.

13 Claims, 2 Drawing Sheets

MULTIGARMENT HANGER WITH PLURAL CLIPS

BACKGROUND OF THE INVENTION

The present invention relates to a garment hanger of plastic construction material for suspending from a support a plurality of garments, and more particularly to such a hanger for supporting both a bra and panties.

There are numerous embodiments of inexpensive plastic, injection-molded hangers to which garments are attached at the factory or other manufacturing site and shipped to the retailer, who then can conveniently transfer the same to his display racks. The hangers referred to are typically known as "ship-on" hangers and afford the obvious convenience to the retailer of having the garment being provided in a display position on a hanger which, in turn, can readily be placed on a support rod of a display rack with little or no handling. Moreover, the hanger is so inexpensive that it is feasible to discard it, if the customer so chooses, when the purchase is completed, the hanger having achieved its primary function of advantageously displaying the garment so as to contribute to the sale thereof. U.S. Pat. No. 4,623,079 discloses a number of these embodiments.

Typically, a multigarment ship-on hanger of plastic construction material comprises a centrally located suspending member for being suspended from a support, a body connected to the base of the suspending member and oriented horizontally when used, and, at each of the opposite ends of the body, a plurality of garment-engaging grips molded integral therewith. Each of the grips is defined by at least a wall surface of the hanger and a resilient finger extending parallel to that wall surface.

More particularly, in order to suspend panties, slacks, trousers, bathing suit bottoms or the like having a waistband, there is at least one downwardly opening grip at each of the opposite ends of the hanger body. Such a grip comprises a vertically oriented wall surface of the hanger extending from a location adjacent the upper edge of the body to a location adjacent the lower edge thereof, and a first resilient finger extending downwardly and spaced outwardly of the vertically oriented wall surface such that there is a first clearance space between one side of the first finger and the vertically oriented wall surface defining a first garment-receiving slot therebetween. The first finger is movable in a direction transverse to and away from the vertically oriented wall surface by displacement to enlarge the first clearance space.

Additionally, in order to suspend a bra, full slip, teddy, bathing suit top or the like having shoulder straps, there is at least one horizontally opening grip at each of the opposite ends of the hanger body. Such a grip comprises a horizontally oriented wall surface of the hanger extending from a location adjacent an end edge of the body to a location inwardly thereof, and a second resilient finger extending horizontally and spaced vertically from the horizontally oriented wall surface such that there is a second clearance space between one side of the second finger and the horizontally oriented wall surface defining a second garment-receiving slot therebetween. The second finger is movable in a direction transverse to and away from the horizontally oriented wall surface by displacement to enlarge the second clearance space.

In particular instances, there will be at each of the opposite ends of the body of the multigarment ship-on hanger merely a single vertically opening grip to accommodate panties or the like and a single horizontally opening grip to accommodate a bra or the like, although in other hanger constructions (as illustrated in the aforementioned U.S. Pat. No. 4,623,079) there may be a pair of the horizontally opening grips, e.g., one to receive the shoulder straps of a bra and one to receive the shoulder straps of a full slip, teddy, or the like.

The same patent notes that it frequently inadvertently happens that the finger of a grip (which in use is pushed away from the opposed wall surface of the hanger body) ruptures or breaks at its connection to the body because of stress which develops in the plastic construction material of the hanger, thereby significantly reducing the period of usefulness thereof. This is most apparent in the vertically opening grip adapted to receive panties and the like because the thickness of the material to be received by the clearance space therein may vary greatly (depending upon whether the material is the sheer elastic waistband of a pair of panties or the relatively thicker waistband of a pair of slacks), so that the finger thereof may have to be displaced to varying degrees from the vertically oriented wall surface. Where, as is customary in the prior art, the vertically oriented wall surface is fixedly disposed, all of the stress associated with the insertion of the panties and the like into the clearance space is concentrated at the connection between the resilient finger and the vertically oriented wall space, thus making this connection a point of weakness where the grip typically breaks.

Breakage of the grip at this point of weakness often occurs at the factory or other manufacturing site when the garments are first placed on the hangers. Even if the grip survives the initial insertion of a garment, it is often subject to repeated usage at the store as the garment is removed from and then replaced on the hanger by store personnel and customers. This repeated usage often results in breakage of the grip. Finally, further use of the grip by the customer at home may also result in breakage.

Because of the high frequency of breakage of the grip, the grip is typically designed to hold the thickest possible garment. This design choice often results in the inability of the grip to hold thinner garments, which then end up on the floor. As such, the versatility of the grip is severely limited.

Another serious problem with prior art multigarment hangers, including those shown in U.S. Pat. No. 4,623,079, is that the use of the downwardly opening grip prevents or inhibits use of the upper horizontally opening grip, because the bight portions of the two grips are closely connected. Specifically, use of the downwardly opening grip causes the finger of the upper horizontally opening grip to move towards the top wall of the hanger resulting in a reduction in the clearance space of the upper horizontally opening grip. In fact, the introduction of a thick garment in the downwardly opening grip often serves to preclude use of the upper horizontally opening grip altogether.

It is an object of the present invention to provide a multigarment hanger of plastic construction material wherein the stress induced at the connection between the finger and the wall surface of the grip is reduced.

Another object is to provide such a hanger wherein the stress at the connection of the downwardly opening grip adapted to receive panties and the like is reduced without affecting the clearance space of any of the other garment-engaging grips.

It is also an object of the present invention to provide such a hanger which can accommodate in the downwardly opening grip waistbands of substantially varying thickness without breaking such grip.

It is a further object to provide such a hanger which is of simple and inexpensive construction.

SUMMARY OF THE INVENTION

It has now been found that the above and related objects of the present invention are obtained in a multi-garment hanger of plastic construction material. The hanger comprises a centrally located suspending member for being suspended from a support, a body connected to the base of the suspending member and oriented horizontally when used, and, at each of the opposite ends of the body, a plurality of garment-engaging grips molded integral therewith. At least one of the garment-engaging grips comprises a vertically oriented wall surface of the hanger extending from a location adjacent the upper edge of the body to a location adjacent the lower edge thereof, and a first resilient finger extending downwardly and spaced outwardly of the vertically oriented wall surface such that there is a first clearance space between one side of the first finger and the vertically oriented wall surface defining a first garment-receiving slot. The first finger is movable in a direction transverse to and away from the vertically oriented wall surface by displacement to enlarge the first clearance space. At least another garment-engaging grip comprises a horizontally oriented wall surface of the hanger extending from a location adjacent an end edge of the body to a location inwardly thereof, and a second resilient finger extending horizontally and spaced vertically from the horizontally oriented wall surface for a major portion of its length such that there is a second clearance space between one side of the second finger and the horizontally oriented wall surface defining a second garment-receiving slot. The second finger is movable in a direction transverse to and away from the horizontally oriented wall surface by displacement to enlarge the second clearance space. At least a portion of the vertically oriented wall surface of the one garment-engaging grip is horizontally displaceable without affecting the second clearance space of any of the other garment-engaging grips.

In a preferred embodiment, the first finger is spaced outwardly of the vertically oriented wall surface for substantially the entire vertical length thereof, and the second finger is spaced vertically above the horizontally oriented wall surface for substantially the entire horizontal length thereof. The portion of the vertically oriented wall surface of the one garment-engaging grip is horizontally displaceable inwardly toward the end edge of the body without affecting the second clearance space of any of the other garment-engaging grips, and at least partially overlaps and is adjacent to (but horizontally spaced from) a vertically extending portion of at least one of the second fingers of the other garment-engaging grips.

BRIEF DESCRIPTION OF THE DRAWING

The above and related objects, features, and advantages of the present invention will be more fully understood by reference to the following detailed description of the presently preferred, albeit illustrative, embodiments of the present invention when taken in conjunction with the accompanying drawing wherein.

DETAILED DESCRIPTION OF THE PREFERRED EMBODIMENTS

Figures 1, 4:
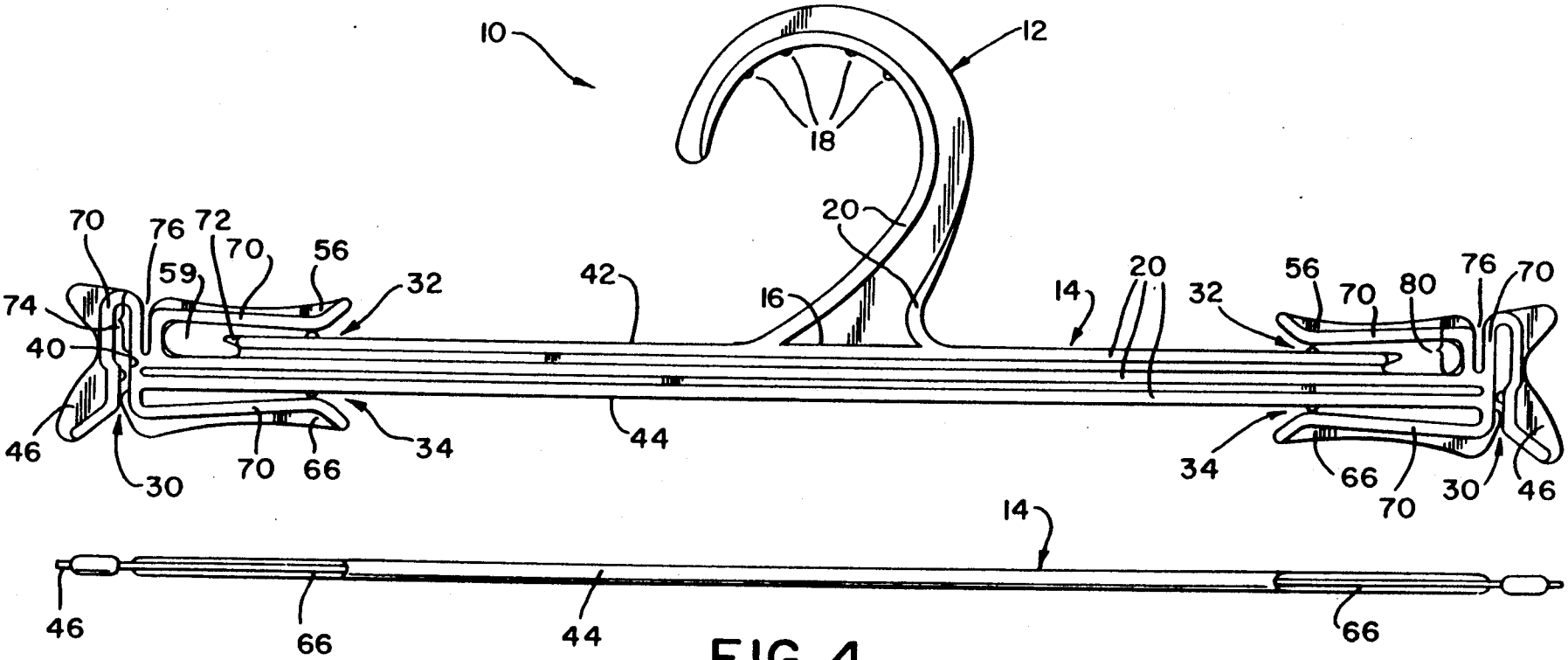
FIG. 1 is a side elevational view of a hanger according to the present invention.
FIG. 4 is a bottom plan view thereof.

Referring now to the drawing, and in particular to FIG. 1 thereof, therein illustrated is a hanger according to the present invention generally designated by the reference numeral 10. In its conventional aspects, the hanger 10 comprises a centrally located suspending member generally designated 12 for being suspended from a support (not shown) and an axially extending body generally designated 14 connected to the base 16 of the suspending member 12 and oriented horizontally when used—i.e., when the hanger is suspended from a support. The suspending member 12 is generally in the form of a hook (as illustrated) so that it may easily be mounted on or dismounted from a support (for example, a horizontal bar mounted at both ends to a fixture). Alternatively, the suspending member 12 may be in the form of a closed circle where it is to be mounted on a cantilevered support having a free end (for example, a horizontal bar projecting outwardly from a fixture).

A plurality of circumferentially spaced ridges 18 may be disposed on the inner circumference of the suspending member 12 in order to facilitate its orientation on the support and to assist in maintaining the body 14 horizontally oriented when the hanger is in use and suspended from a support. Various marginal and other ribs or like thickened portions 20 may be provided on both the suspending member 12 and the body 14 in order to strengthen and rigidify the same against the anticipated forces tending to straighten out the suspending member 12 or downwardly bow the ends of the body 14 when garments are suspended from the hanger.

Figure 2:
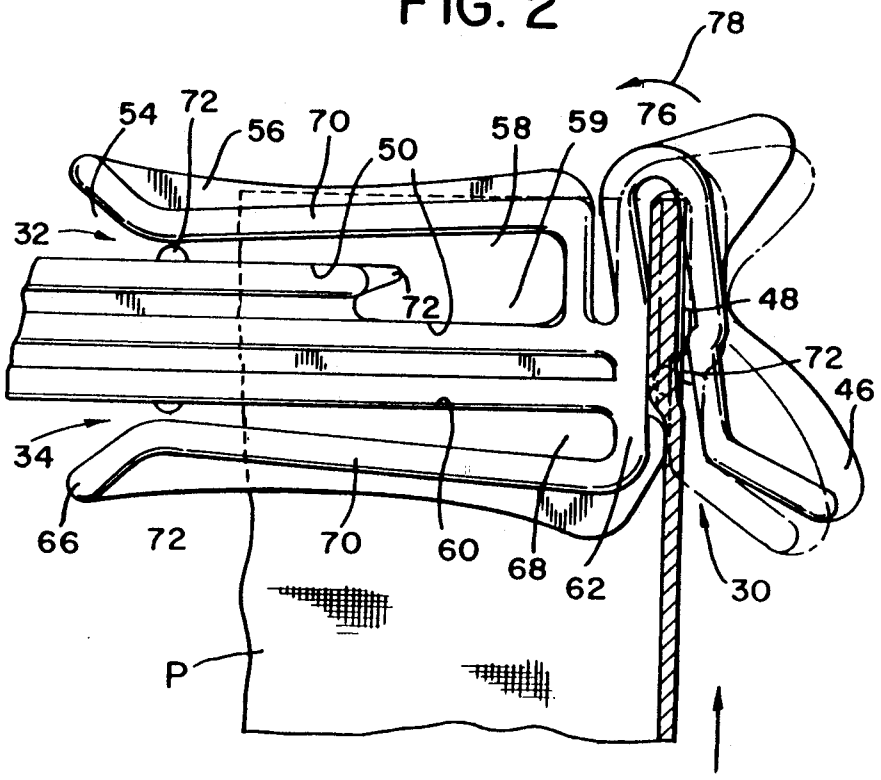
FIG. 2 is a fragmentary side elevational view, to a greatly enlarged scale, of the grips at the right end of the hanger body with panties inserted in one of the grips.
Figure 3:
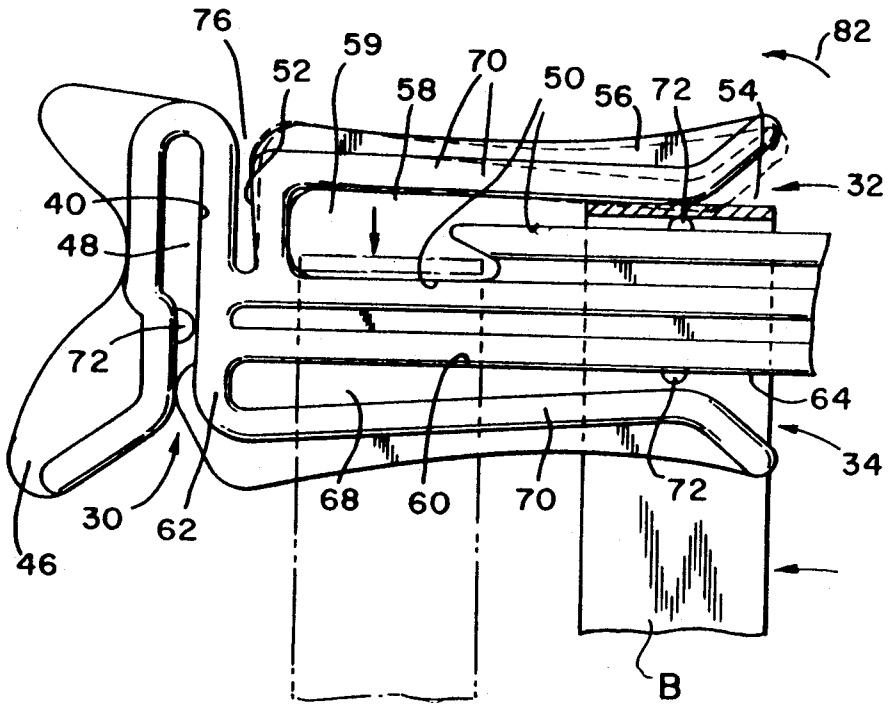
FIG. 3 is a fragmentary side elevational view, to a greatly enlarged scale, of the grips at the left end of the hanger body with a bra shoulder strap in solid line in an intermediate position of insertion and in phantom line in a final inserted position.

Referring now to FIGS. 2 and 3 as well, at each of the opposite ends of the body 14, there are molded integral therewith (for example, by an injection or other plastic molding operation) a plurality of garment-engaging grips including at least a downwardly-opening grip generally designated 30 for receiving panties P, slacks, trousers, bathing suit bottoms and the like, and at least one horizontally-opening grip generally designated 32 for receiving the shoulder straps of bras B, full slips, teddies, and the like. As illustrated, a second horizontally-opening grip generally designated 34 may also be provided for receiving the shoulder straps of bras, full slips, teddies, dresses and the like, the grip 32 being disposed above the body 14 whereas the grip 34 is disposed below the body 14.

The downwardly opening grip 30 comprises a vertically oriented wall surface 40 of the hanger extending from a location adjacent the upper edge 42 of the body 14 to a location adjacent the lower edge 44 thereof and a first resilient finger 46 extending downwardly and spaced outwardly from the vertically oriented wall surface 40 such that there is a clearance space 48 between one side of the first finger 46 and the vertically oriented surface 40 defining a first garment-receiving slot. The first finger 46 is movable in the direction transverse to and away from the vertically oriented wall surface 40 by displacement to enlarge the first clearance space 48. The first finger 46 is preferably spaced outwardly of the vertically oriented wall surface 40 for substantially the entire vertical length thereof.

The horizontally opening grip 32 comprises a horizontally oriented wall surface 50 of the hanger extending from a location adjacent an end edge 52 of the body 14 to a location 54 inwardly thereof, and a second resilient finger 56 extending horizontally and spaced vertically above the horizontally oriented wall surface 50 for a major portion of its length such that there is a second clearance space 58 between one side of the second finger 56 and the horizontally oriented wall surface 50 defining a second garment-receiving slot. The second finger 56 is movable in the direction transverse to and away from the horizontally oriented wall surface 50 by displacement to enlarge the second clearance space 58. The second finger 56 is preferably spaced vertically upwardly of the horizontally oriented wall surface 50 for substantially the entire horizontal length thereof. The horizontally oriented wall surface 50 may define a recess 59 (as illustrated) adapted to receive the narrow shoulder strap of a bra, full slip, teddy or the like, and resist its accidental displacement from the grip 32.

Optionally, and as illustrated, another horizontally opening grip 34 may be provided for supporting the same type of articles as the horizontally opening grip 32 or a dress with relatively wide shoulder bands. The grip 34 comprises a horizontally oriented wall surface 60 of the hanger extending from a location adjacent an end edge 62 of the body 14 to a location 64 inwardly thereof, and a third resilient finger 66 extending horizontally and spaced vertically below the horizontally oriented wall surface 60 for a major portion of its length such that there is a third clearance space 68 between one side of the third finger 66 and the horizontally oriented wall surface 60 defining a third garment-receiving slot therebetween. The third finger 66 is movable in the direction transverse to and away from the horizontally oriented wall surface 60 by displacement to enlarge the third clearance space 68. The third finger 66 is preferably spaced vertically downwardly of the horizontally oriented wall surface 60 for substantially the entire horizontal length thereof.

It will be appreciated that whereas the horizontally opening grip 32 is disposed above the centerline of the body 14 with the second finger 56 spaced vertically above the top of the horizontally oriented wall surface 50, the horizontally oriented grip 34 is disposed below the centerline of the body 14 with the third finger 66 spaced vertically below the bottom of the horizontally oriented wall surface 60. Similarly, whereas the second resilient finger 56 of grip 32 is displaced upwardly from the horizontally oriented wall surface 50 to enlarge the second clearance space 58 and enable the passage of garments intermediate the finger 56 and the horizontally oriented wall surface 50, the third resilient finger 66 of grip 34 is displaced downwardly from the horizontally oriented wall surface 60 to enlarge the third clearance space 68 and enable the passage of garments intermediate the finger 66 and the horizontally oriented wall surface 60.

As is customary, the resilient fingers 46, 56, 66 may be provided with ribs or like thickened portions 70 for added strength and rigidity. Similarly, as is also conventional, either the resilient fingers 46, 56, 66 or the wall surfaces 40, 50, 60 opposite the respective fingers 46, 56, 66, or both, may be provided with small bumps o projections 72 in order to assist in closing the clearance spaces 48, 58, 68 of the respective grips 30, 32, 34. Projections 72 may also be provided in connection with each recess 59 to better retain shoulder straps or the like within each recess 59.

A critical feature of the present invention is that at least a portion 74 of the vertically oriented wall surface 40 of the downwardly opening grip 30 is horizontally displaceable —that is, is displaceable inwardly toward the center of the body 14 in the direction of arrow 78. This enables the stress that would otherwise be concentrated at the connecting portion between the resilient finger 46 and an immobile or fixed vertically oriented wall surface 40 to be distributed at least over the vertically oriented wall surface portion 74, thereby reducing breakage of the grip 30 due to such stress.

According to the present invention, the displaceable portion 74 of the vertically oriented wall surface 40 is made horizontally displaceable inwardly, preferably by provision of an open-topped slot or gap means 76 which separates the displaceable portion 74 from the grip 32. The slot 76 is additionally of suitable dimensions to accommodate as well the typically lesser movement of the resilient bight or connecting portion 80 of the second resilient finger 56 of grip 32 relative to the horizontally oriented wall surface 50 as that bight portion 80 moves outwardly toward the first grip 30, and in particular toward the displaceable portion 74 thereof, in the direction of arrow 82. This enables the stress that would otherwise be concentrated at the connection between the bight portion 80 and the remainder of the second finger 56 (which would occur if the bight portion 80 were fixed and immovable) to be distributed over the entire resilient bight portion 80 defining part of the slot 76. Accordingly, it will be appreciated that the single slot 76 enables the distribution of stresses within both grips 30 and 32, thereby to reduce the likelihood of breakage of each during use. The displaceable portion 74 of the vertically oriented wall surface 40 of the grip 30 at least partially overlaps and is adjacent to, but horizontally spaced from, the vertically extending bight portion 80 of the horizontally oriented wall surface 50 of the grip 32.

Most importantly, the slot 76 enables the displaceable portion 74 of the vertically oriented wall surface 40 of the first grip 30 to be horizontally displaceable without affecting the second clearance space 58 of the second grip 32 (or, for that matter, the third clearance space 68 of the third grip 34). Similarly, the slot 76 permits the bight portion 80 of the second grip 32 to be horizontally displaceable without affecting the first clearance space 48 of the first grip 30 (or, for that matter, the third clearance space 68 of the third grip 34). As will be readily appreciated, in the absence of slot 76 movement of displaceable portion 74 would be reflected in movement of bight portion 80, and vice versa, so that the introduction of a garment into one of grips 30, 32 would render more difficult the introduction of a garment into or removal of a garment from the other grip 32, 30. More particularly, the presence of a garment in grip 30 would increase the bias of finger 56 towards projection 72 of surface 50 of the second grip 32, just as the presence of a garment in grip 32 would increase the bias of projection 72 on surface 40 of the first grip 30.

The hanger 10 is formed of plastic construction material and is preferably of one piece, integral and unitary construction. A preferred plastic construction material is polystyrene, polypropylene or K resin, although other materials which, depending upon their configuration and dimensions, may be either resilient or rigid, may also be used.

The multigarment hanger 10 according to the present invention is used in the same manner as the conventional multigarment hanger, with the resilient fingers 46, 56 and 66 being displaced outwardly, upwardly or downwardly from their respective opposed wall surfaces 40, 50, 60 (with fingers 46 and 56 being disposed from their phantom line orientations in FIGS. 2 and 3 to their solid line orientations) as necessary to enable the desired garment to be inserted into or removed from the respective clearance spaces 48, 58, 68. However, unlike the conventional multigarment hangers, wherein the presence of a garment in one grip may render more difficult the passage of another garment through another grip of that same body end, the grips 30 and 32 (and the optional grip 34) are essentially independent of one another so that the use of one grip does not affect the clearance space of any of the other grips on the same body end.

To summarize, the present invention provides a multigarment hanger of plastic construction material wherein the stress induced at the connection between the finger and the wall surface of the grip is reduced, and in particular the stress at the connection of the grip adapted to receive panties and the like is reduced without affecting the clearance space of any of the other garment-engaging grips. The hanger can accommodate in the downwardly-opening grip waistbands of substantially varying thickness without breaking such grip. Finally, the hanger is of simple and inexpensive construction.

Now that the preferred embodiments of the present invention have been shown and described in detail, various modifications and improvements thereon will become readily apparent to those skilled in the art. Accordingly, the spirit and scope of the present invention is to be construed broadly and limited only by the appended claims, and not by the foregoing specification.

I claim:

1. A multigarment hanger of plastic construction material comprising:

(A) a centrally located suspending member for being suspended from a support;

(B) a body connected to the base of said suspending member and oriented horizontally when used; and (C) at each of the opposite ends of said body, a plurality of garment-engaging grips molded integral therewith;

(i) at least one said garment-engaging grip comprising a vertically oriented wall surface of said hanger extending from a location adjacent the upper edge of said body to a location adjacent the lower edge thereof, and a first resilient finger extending downwardly and spaced outwardly of said vertically oriented wall surface such that there is a first clearance space between one side of said first finger and said vertically oriented wall surface defining a first garment-receiving slot, said first finger being movable in a direction transverse to and away from said vertically oriented wall surface by displacement to enlarge said first clearance space;

(ii) at least another said garment-engaging grip comprising a horizontally oriented wall surface of said hanger extending from a location adjacent an end edge of said body to a location inwardly thereof, and a second resilient finger extending horizontally and spaced vertically from said horizontally oriented wall surface for a major portion of its length such that there is a second clearance space between one side of said second finger and said horizontally oriented wall surface defining a second garment-receiving slot, said second finger being movable in a direction transverse to and away from said horizontally oriented wall surface by displacement to enlarge said second clearance space; and (iii) gap means, disposed intermediate at least a portion of said horizontally oriented wall surface of said another garment-engaging grip and at least a portion of said vertically oriented wall surface of said one garment-engaging grip, for providing a third clearance space and making said vertically oriented wall surface portion horizontally displaceable relative to said body ends without affecting said second clearance space of any of said another garment-engaging grips.

2. The hanger of claim 1 wherein said first finger is spaced outwardly of said vertically oriented wall surface for substantially the entire vertical length thereof.

3. The hanger of claim 1 wherein said second finger is spaced vertically of said horizontally oriented wall surface for substantially the entire horizontal length thereof.

4. The hanger of claim 2 wherein said second finger is spaced vertically above said horizontally oriented wall surface for substantially the entire horizontal length thereof.

5. The hanger of claim 1 wherein said portion of said vertically oriented wall surface of said one garment-engaging grip is horizontally displaceable inwardly toward and relative to said end edge of said body without affecting said second clearance space of any of said another garment-engaging grips.

6. The hanger of claim 1 wherein said portion of said vertically oriented wall surface of said one garment-engaging grip overlaps and is adjacent to but horizontally spaced by said gap means from a vertically extend portion of at least one of said another garment-engaging grips.

7. A multigarment hanger of plastic construction material comprising:

(A) a centrally located suspending member for being suspended from a support;

(B) a body connected to the base of said suspending member and oriented horizontally when used; and (C) at each of the opposite ends of said body, a plurality of garment-engaging grips molded integral therewith;

(i) at least one said garment-engaging grip comprising a vertically oriented wall surface of said hanger extending from a location adjacent the upper edge of said body to a location adjacent the lower edge thereof, and a first resilient finger extending downwardly and spaced outwardly of said vertically oriented wall surface such that there is a first clearance space between one side of said first finger and said vertically oriented wall surface defining a first garment-receiving slot, said first finger being movable in a direction transverse to and away from said vertically oriented wall surface by displacement to enlarge said first clearance space; and (ii) at least another said garment-engaging grip comprising a horizontally oriented wall surface of said hanger extending from a location adjacent an end edge of said body to a location inwardly thereof, and a second resilient finger extending horizontally and spaced vertically from said horizontally oriented wall surface for a major portion of its length such that there is a second clearance space between one side of said second finger and said horizontally oriented wall surface defining a second garment-receiving slot, said second finger being movable in a direction transverse to and away from said horizontally oriented wall surface by displacement to enlarge said second clearance space;

at least a portion of said vertically oriented wall surface of said one garment-engaging grip being horizontally displaceable inwardly toward and relative to said end edge of said body without affecting said second clearance space of any of said another garment-engaging grips, and said portion of said vertically oriented wall surface of said one garment-engaging grip overlapping and being adjacent to but horizontally spaced by gap means from a vertically extending portion of at least one of said second fingers of one of said another garment-engaging grips.

8. The hanger of claim 1 wherein the upper portion of said vertically oriented wall surface of said one garment-engaging grip is horizontally displaceable relative to an adjacent one of said body ends without affecting said second clearance space of any of said another garment-engaging grips.

9. The hanger of claim 8 wherein said second finger is spaced vertically above said horizontally oriented wall surface for substantially the entire horizontal length thereof and said upper portion of said vertically oriented wall surface of said one garment-engaging grip is horizontally displaceable inwardly towards and relative to an adjacent one of said edges of said body without affecting said second clearance space of any of said another garment-engaging grips.

10. The hanger of claim 8 wherein said upper portion of said vertically oriented wall surface of said one garment-engaging grip overlaps and is adjacent to but horizontally spaced by said gap means from a vertically extending portion of at least one of said another garment-engaging grips.

11. The hanger of claim 7 wherein the upper portion of said vertically oriented wall surface of said one garment-engaging grip is horizontally displaceable relative to an adjacent one of said body ends without affecting said second clearance space of any of said another garment-engaging grips.

12. The hanger of claim 11 wherein said second finger is spaced vertically above said horizontally oriented wall surface for substantially the entire horizontal length thereof and said upper portion of said vertically oriented wall surface of said one garment-engaging grip is horizontally displaceable inwardly towards and relative to an adjacent one of said edges of said body without affecting said second clearance space of any of said another garment-engaging grips.

13. The hanger of claim 7 wherein said upper portion of said vertically oriented wall surface of said one garment-engaging grip overlaps and is adjacent to but horizontally spaced by said gap means from a vertically extending portion of at least one of said another garment-engaging grips.

* * * * *